US005434578A

United States Patent [19]

Stehlik

[11] Patent Number: 5,434,578

[45] Date of Patent: Jul. 18, 1995

[54] APPARATUS AND METHOD FOR AUTOMATIC ANTENNA BEAM POSITIONING

[75] Inventor: Roy R. Stehlik, Columbia, Md.

[73] Assignee: Westinghouse Electric Corp., Pittsburgh, Pa.

[21] Appl. No.: 139,674

[22] Filed: Oct. 22, 1993

[51] Int. Cl.[6] ..... H01J 29/52

[52] U.S. Cl. ..... 342/383; 342/380; 342/382

[58] Field of Search ..... 342/380, 382, 383

[56] References Cited

U.S. PATENT DOCUMENTS

| | | | |
|---|---|---|---|
| 3,175,216 | 8/1962 | Enloe . | |
| 4,017,867 | 4/1977 | Claus . | |
| 4,119,972 | 10/1978 | Fletcher et al. . | |
| 4,123,759 | 10/1978 | Hines et al. . | |
| 4,217,586 | 8/1980 | McGuffin . | |
| 4,577,193 | 3/1986 | Kiuchi et al. | 342/380 |
| 4,651,155 | 3/1987 | Baurle et al. . | |
| 4,654,667 | 3/1987 | Apostolos et al. . | |
| 4,717,919 | 1/1988 | Cherrette et al. . | |
| 4,736,460 | 4/1988 | Rilling . | |
| 4,771,289 | 9/1988 | Masak . | |
| 5,166,693 | 11/1992 | Nishikawa et al. . | |

OTHER PUBLICATIONS

B. Widrow et al., "Adaptive Antenna Systems," Proceedings of the IEEE, vol. 55, No. 12, Dec. 1967, pp. 2143–2159.

Sidney P. Applebaum, "Adaptive Arrays," IEEE Transactions on Antennas and Propagation, vol. AP-24, No. 5, Sep. 1976, pp. 585–598.

Charles M. Hackett, Jr., "Adaptive Arrays Can Be Used To Separate Communication Signals," IEEE Transactions on Aerospace and Electronic Systems, vol. AES-17, No. 2, Mar. 1981, ppm 234–247.

*Primary Examiner*—Theodore M. Blum

*Attorney, Agent, or Firm*—Christopher O. Edwards

[57] ABSTRACT

A system for automatically forming a receive beam being positioned in the direction of a corresponding incoming signal, the system having a known signal corresponding to the incoming signal. The system comprises a plurality, M, of channels, each of the channels collecting the incoming signal and generating a plurality, L, of incoming complex data samples for the incoming signal and a plurality, L, of known complex data samples for the known signal. The system also includes severaly digital beamforming means for forming the receive beam. Each of the digital beamforming means includes means, coupled to the channels, for computing an M by 1 weight vector, W, having several weight elements each corresponding to one of the channels, the computing means including means for solving, for W, the equation, R W=C, where R is an M by M coefficient matrix, an element in the i-th row and the j-th column being an estimate of a value obtained from cross-correlating the incoming complex data sample generated by the i-th channel with the incoming complex data sample of the j-th channel, and where C is an M by 1 constant vector, an element in the i-th row being an estimate of a value obtained from cross-correlating the incoming complex data sample generated by the i-th channel with the known complex data samples. Each of the digital beamforming means further includes multipliers for generating weighted signals, each of the multipliers coupled to a corresponding one of the channels and multiplying one of the weight elements by the incoming complex data samples generated by the corresponding channel, and an adder, coupled to the multipliers, for adding each of the weighted signals.

12 Claims, 2 Drawing Sheets

APPARATUS AND METHOD FOR AUTOMATIC ANTENNA BEAM POSITIONING

BACKGROUND OF THE INVENTION

1. Field of the Invention

The present invention relates to automatic adaptive beam positioning antennas for mobile satellite communications. More particularly, the invention relates to fixed arrays of several omnidirectional antennas, weighted and combined to form at least one receive beam adaptively pointed in the direction of a corresponding incoming signal.

2. Description of the Related Art

Satellite communications is generally performed at microwave frequencies. Power levels at such frequencies normally require a directional gain antenna coupled to a receiver and pointed at the satellite with which the receiver is communicating.

With a fixed ground station receiver, the need for directional gain is of no consequence, because (assuming a geostationary satellite) the antenna can be positioned appropriately during site installation and never repositioned. This is also true with some mobile installations in which the vehicle having the receiver is stationary while communicating with the satellite.

In "true" mobile satellite communications, however, where the vehicle is moving while communicating with the satellite and/or while the satellite is also moving, the need for directional gain can pose a problem. If a mechanically positioned directional antenna (e.g., a tracking dish) is used, it must be continually positioned and repositioned. Mechanically actuated tracking can be slow, however, being dependent on the power of the servo motor and/or the weight of the antenna. Alternatively, an omnidirectional antenna can be used to receive signals in a true mobile satellite communications application. These antennas, however, generally lack the requisite gain to adequately perform in this application.

Accordingly, a need exists for a digital signal processing technique to achieve an automatically, adaptive electronic beam positioning system for mobile satellite communications requiring an antenna that can be rapidly and continually steered in the direction of incoming signals.

SUMMARY OF THE INVENTION

Accordingly, the present invention is directed to an apparatus and method for automatic antenna beam positioning using digital signal processing techniques, substantially obviating one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the apparatus and method particularly pointed out in the written description and claims hereof, as well as the appended drawings.

To achieve these and other advantages and in accordance with the purpose of the invention, as embodied and broadly described herein, the invention is a system for automatically forming at least one receive beam positioned in the direction of a corresponding at least one incoming signal, the system having at least one known signal corresponding to the at least one incoming signal. The system comprises: a plurality, M, of channels, each of the plurality of channels collecting the at least one incoming signal and generating a plurality, L, of incoming complex data samples for the at least one incoming signal and a plurality, L, of known complex data samples for the at least one known signal; and a plurality of digital beamforming means for forming the at least one receive beam, each of the plurality of digital beamforming means including means, coupled to the plurality of channels, for computing an M by 1 weight vector, W, having a plurality of weight elements each corresponding to one of the plurality of channels, the computing means including means for solving, for W, the equation, $R\,W=C$, wherein R is an M by M coefficient matrix, an element in the i-th row and the j-th column of the coefficient matrix being an estimate of a value obtained from cross-correlating the incoming complex data sample generated by the i-th channel with the incoming complex data sample of the j-th channel, and wherein C is an M by 1 constant vector, an element in the i-th row of the constant vector being an estimate of a value obtained from cross-correlating the incoming complex data sample generated by the i-th channel with the plurality of known complex data samples, a plurality of multipliers for generating a plurality of weighted signals, each of the plurality of multipliers coupled to a corresponding one of the plurality of channels and multiplying one of the plurality of weight elements by the plurality of complex data samples generated by the corresponding one of the plurality of channels, and an adder, coupled to the plurality of multipliers, for adding each of the plurality of weighted signals.

In another aspect, the present invention is a method for automatically forming at least one receive beam positioned in the direction of a corresponding at least one incoming signal, the system having at least one known signal corresponding to the at least one incoming signal. The method comprises: collecting, using a plurality of channels, the at least one incoming signal and generating a plurality, L, of incoming complex data samples for the at least one incoming signal and a plurality, L, of known complex data samples for the at least one known signal; and digitally forming the at least one receive beam, including computing an M by 1 weight vector, W, having a plurality of weight elements each corresponding to one of said plurality of channels, including solving, for W, the equation, $R\,W=C$, wherein R is an M by M coefficient matrix, an element in the i-th row and the j-th column of the coefficient matrix being an estimate of a value obtained from cros-correlating the incoming complex data sample generated by the i-th channel with the incoming complex data sample of the j-th channel, and wherein C is an M by 1 constant vector, an element in the i-th row of the constant vector being an estimate of a value obtained from cross-correlating the incoming complex data sample generated by the i-th channel with the plurality of known complex data samples, multiplying each of the plurality of weight elements by the plurality of complex data samples generated by the corresponding one of the plurality of channels, and adding the multiplied weight elements.

It is to be understood that both the foregoing general description and the following detailed description are exemplary and explanatory only and are intended to provide further explanation of the invention, as claimed.

The accompanying drawings are included to provide a further understanding of the invention and are incorporated in and constitute a part of this specification, to illustrate the embodiments of the invention, and, together with the description, to serve to explain the principles of the invention.

DETAILED DESCRIPTION OF THE INVENTION

Reference will now be made in detail to the present preferred embodiment of the invention, an example of which is illustrated in the accompanying drawings. Whereever possible, the same reference numbers will be used throughout the drawings to refer to the same or like parts.

In accordance with the present invention, a system and method are provided for automatically forming at least one receive beam positioned in the direction of a corresponding at least one incoming signal. The system comprises a plurality of channels, each channel having an antenna and a receiver, and at least one digital beamforming means.

Figure 1:
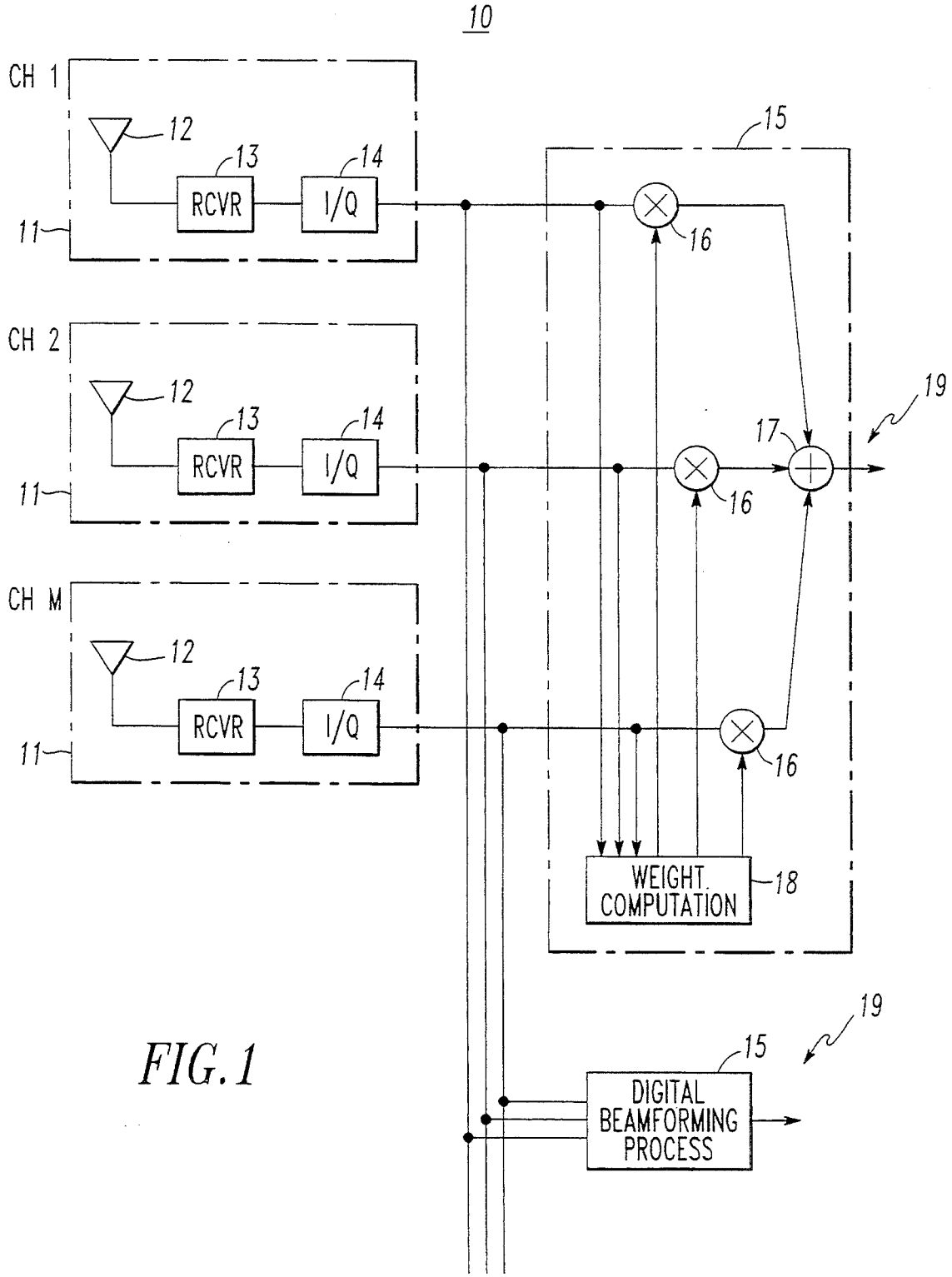
FIG. 1. is a diagramattical representation of a system for adaptively positioning a receive beam in mobile satellite communications, showing a digital beamforming apparatus in accordance with the present invention.

An exemplary embodiment of the system of the present invention is shown in FIG. 1 and is designated generally by reference numeral 10.

As embodied and shown in FIG. 1, the system 10 of the present invention includes a plurality of channels 11; and at least one digital beamforming means 15. The system automatically forms a receive beam positioned in the direction of a corresponding incoming signal, which is collected and processed by one of the plurality of channels 11. The details of this system are described below.

The system of the present invention, as shown in FIG. 1, includes a plurality of channels 11. Each channel 11 includes an antenna 12, preferably an omni antenna, for collecting the incoming signal or signals. Taken together, the plurality of antennas 12, one for each channel, form a fixed array of antenna elements. The array can be arranged, for example, in a linear fashion, or in any other effective pattern, as is well known in the art. See, e.g., Benjamin Rulf & Gregory A. Robertshaw, Understanding Antennas for Radar, Communications, and Avionics 137–92 (Van Nostrand Reinhold Co. 1987). Preferably, a non-linear array is used in the system of the present invention.

Each channel 11 also includes an identical receiver 13, each receiver operating on a common frequency, as well as means 14 for digitally generating in-phase ("I") and quadrature-phase ("Q") components for each incoming signal. Each receiver 13 processes incoming signals, including amplifying the signals, downconverting the signals from a transmission band frequency to baseband frequency (i.e., 0 Hertz), and analog-to-digital ("A/D") converting the signals. Because dynamic range requirements for satellite communications are generally relaxed, in comparison, for example, with radar, the A/D bit width is correspondingly smaller for satellite communications than radar. For example, 8 or 10 bits at a sampling rate of several hundred kilohertz are adequate for mobile satellite communications systems. At such a bit width and sampling rate, a monolithic digital receiver can be implemented to process the incoming signals. The signal output from the channels 11 are herein referred to as incoming data samples.

As shown in FIG. 1, the system of the present invention also includes at least one digital beamforming means 15, into which are input the processed complex incoming signals (i.e., the incoming data samples having I and Q components). Each digital beamforming means 15 corresponds to an incoming signal and digitally forms a receive beam 19 directed toward the corresponding incoming signal. Moreover, each digital beamforming means 15 includes means for computing weight vectors 18, a number of multipliers 16 (one corresponding to each channel 11), and an adder 17. The details of the digital beamforming means 15 are described below.

In accordance with the present invention, the incoming data samples from each of the channels are input to a weight computation means 18 and a corresponding multiplier 16. The weight computation means 18, in turn, computes a weight vector corresponding to the incoming data samples output from the channels. The weight vector has the same number of components as there are channels 11 in the system 10, as shown in FIG. 1. Once computed, each component of the weight vector is multiplied by the corresponding set of incoming data samples using the multipliers 16, as also shown in FIG. 1. Upon being multiplied, the resulting multiplied (i.e., weighted) data samples are added using the adder 17. The output from the adder 17 is a receive beam 19 directed toward the direction of the received incoming signal.

The receive beam 19 can be updated by a predetermined update rate, and the weight vector can be held until recalculated at the end of the update period. The update rate need only be as fast as required by vehicle motion. For example, for many mobile satellite communications applications, an update rate of several (e.g., between 2 and 10) Hertz will be adequate.

As embodied herein, the algorithm to compute weight vectors is as follows. Assume that the system of the present invention has M channels weighted and combined to form and output a receive beam 19, designated "y." The output of the system 10 at the j-th instant is thus:

$$y_j = X_j^T W, \tag{1}$$

where $X_j^T$ is the transposed matrix of incoming data samples at the j-th instant, and W is the weight vector.

Consider L such instants (that is, consider the incoming signal being sampled by the channel L times), and suppose it is known that the signal $y_j$ is some known signal $d_j$. That is, because it is desired to receive the signal $y_j$, there will prior knowledge of some unique characteristic $d_j$ that identifies the signal $y_j$. For example, the known characteristic $d_j$ of $y_j$ could be a pilot tone or a subcarrier broadcast along with the signal.

The optimum weight vector, W, will be chosen to minimize the total squared error between $y_j$ and $d_j$ over the L observation points, i.e., the incoming data sample points.

Thus, letting "*" denote matrix conjugation and "T" denote matrix transposition, $$e_j = d_j - X_j^T W, \tag{2}$$

$$E = D - X^T W, \tag{3}$$

where $$E = \begin{vmatrix} e_1 \\ e_2 \\ \cdot \\ \cdot \\ \cdot \\ e_L \end{vmatrix}, D = \begin{vmatrix} d_1 \\ d_2 \\ \cdot \\ \cdot \\ \cdot \\ d_L \end{vmatrix}, \text{ and } W = \begin{vmatrix} w_1 \\ w_2 \\ \cdot \\ \cdot \\ \cdot \\ w_M \end{vmatrix}.$$

In equations (2) and (3), the raw data matrix for X is:

$$X = \begin{vmatrix} x_{11} & x_{12} & \cdots & x_{1L} \\ x_{21} & x_{22} & \cdots & x_{2L} \\ \cdot & \cdot & & \cdot \\ \cdot & \cdot & & \cdot \\ \cdot & \cdot & & \cdot \\ x_{M1} & x_{M2} & \cdots & x_{ML} \end{vmatrix} \tag{4}$$

Using equation (3), the total error for the system is calculated as follows:

$$\begin{aligned} E_{Total} &= E^T E^* = (D - X^T W)^T (D - X^T W)^* \\ &= D^T D^* - D^T X^{*T} W^* - W^T X D^* + W^T X X^{*T} W^*. \end{aligned} \tag{5}$$

Minimizing the total error from equation (5) involves setting the complex gradient of $E_{Total}$ to 0. Thus:

$$_W E_{Total} = 0 = 0 - 2(X^* D) - 0 + 2(X X^{*T})^T W. \tag{6}$$

From equation (6), it follows:

$$(X^* X^T)\, W = X^* D, \tag{7}$$

$$R\, W = C. \tag{8}$$

And equation (7) or (8) can be solved for the weight vectors, W.

From equation (8), R is called a coefficient matrix, having a dimension of M by M, M being the number of channels. The coefficient matrix, R, is obtained by multiplying the complex conjugate of the data matrix, X, by the transpose of the data matrix, X, and, for R, the element of the i-the row and j-th column is an estimate of the value obtained from cross-correlating the incoming complex signal received by the i-th channel with the incoming complex signal received by the j-th channel. Also from equation (8), C is a constant vector having a dimension of M by 1, which is obtained by multiplying the complex conjugate of the data matrix, X, by the the known signal vector, D, and of which the element of the i-th row is an estimate of the value obtained from cross-correlating the incoming complex signal of the i-th channel with the known complex signal.

Close examination of equation (7) reveals some interesting properties. Suppose several, say N, temporally and mutually uncorrelated (although spatially correlated) incoming signals from as many different directions were simultaneously impinging on an array of antenna elements 12. The resulting channel output signal vector, X, is as follows:

$$X = N + S\, V, \tag{9}$$

where:

$$N = \begin{vmatrix} n_{11} & n_{12} & \cdots & n_{1L} \\ n_{21} & n_{22} & \cdots & n_{2L} \\ \cdot & \cdot & & \cdot \\ \cdot & \cdot & & \cdot \\ \cdot & \cdot & & \cdot \\ n_{M1} & n_{M2} & \cdots & n_{ML} \end{vmatrix}, \tag{10}$$

$$S = \begin{vmatrix} e^j & e^j & \cdots & e^j \\ e^j & e^j & \cdots & e^j \\ \cdot & \cdot & & \cdot \\ \cdot & \cdot & & \cdot \\ \cdot & \cdot & & \cdot \\ e^j & e^j & \cdots & e^j \end{vmatrix}, \text{ and}$$

$$V = \begin{vmatrix} v_{11} & v_{12} & \cdots & v_{1L} \\ v_{21} & v_{22} & \cdots & v_{2L} \\ \cdot & \cdot & & \cdot \\ \cdot & \cdot & & \cdot \\ \cdot & \cdot & & \cdot \\ v_{N1} & v_{N2} & \cdots & v_{NL} \end{vmatrix} = [V_1\, V_2 \ldots V_N]^T.$$

In equations (9) and (10), N is a noise matrix, S is a matrix of steering vectors, and V is a matrix of incoming signals. By setting D proportional to one of these vectors, for example, $V_k$, equation (7) becomes:

$$(X^* X^T)\, W = X^* D \simeq \mu S_k^*. \tag{11}$$

Equation (11) results because the signals are assumed mutually uncorrelated in time. The symbol "$\mu$" is some constant dependent on signal strength.

Equation (11) is a control law, in which the criterion is maximum signal to noise ("S/N") ratio at the beamformer output, and in which the receive beam emanating from the antenna array is steered in the direction of the k-th incoming signal as desired. This control law is similar to the control law derived by Applebaum for adaptive array processing for radar. See Sidney P. Applebaum, "Adaptive Arrays," IEEE Transactions on Antennas & Propagation, Vol. AP-24, No. 5, September 1976, pp. 585–98. To solve equation (1) as Applebaum teaches in this article requires a priori knowledge of the steering vector, $S_k$, corresponding to the direction from which the desired incoming signal is impinging on the antenna array. The present invention does not require such a priori knowledge; i.e., the direction of the desired incoming signal can be completely unknown.

By supplying the system 10 with a replica of the incoming signal desired to be received, the system 10 will automatically steer the receive beam 19 in the direction of that incoming signal, with no prior knowledge of that direction. The system does this steering very nearly optimally (if maximum S/N ratio is the criterion).

Similarly, the system 10 will also steer the receive beam 19 in the direction of an incoming signal having a known characteristic, where the signal is coming from several directions. In this case, several main lobes will generally be formed in the receive beam 19, each lobe centered on one of the directions from which the incoming signal is coming. Formation of multiple lobes can be a drawback in the system 10, however, because it may render the system prone to multipath or bistatic effects in some circumstances.

It should be noted that, in the system of the present invention, the gain of the array of antennas 12 is greater than that of a single omnidirectional antenna, because of the beamforming process occurring in the digital beamforming means 15. The antennas 12 in the array combine coherently in the steered direction for signals, non-coherently for noise, causing a S/N ratio improvement over a single omnidirectional antenna. For example, as is well known in the art, an array of six antennas 12 yields a S/N ratio improvement of 7.78 dB, while an array of eight yields a 9 dB improvement.

It should also be noted that, in the system of the present invention, the fixed channel-to-channel phase differences, which are constant over the signal bandwidth, are automatically accounted for by the system of the present invention. This is because phase shift is embodied in the steering vector, S, through the data matrix, X. Phase shifts between the channels 11 could arise from manufacturing tolerances in the system, or imperfect spacing of the antenna elements 12 in the array, as may result when individual antenna elements are installed in lieu of a multi-element assembly.

Figure 2:
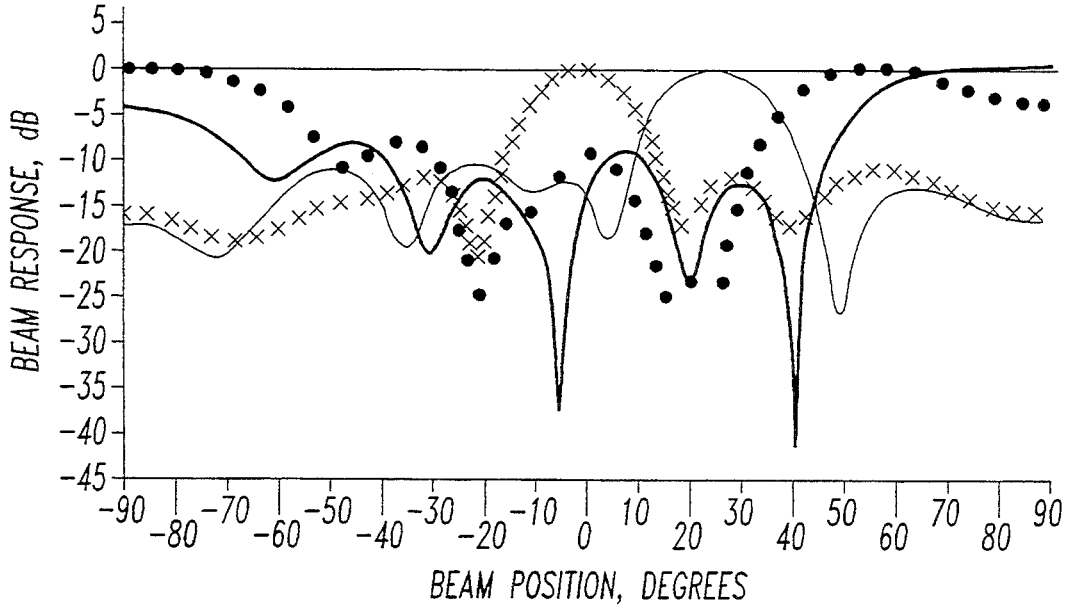
FIG. 2 shows an example of receive beam positioning performed in accordance with the present invention for a single incoming signal at four different positions, namely, 0 degrees, 25 degrees, 50 degrees, and 75 degrees.

In accordance with the present invention, FIG. 2 shows the result of a simulation evaluating the case of a six element linear array of antennas 12, having half wavelength spacing, and a S/N ratio of 40 dB. As shown, incoming signals at 0 degrees, 25 degrees, 50 degrees, and 75 degrees were applied (in four mutually exclusive, separate simulations). The system of the present invention, using weight computation means 18 in accordance with the above equations, successfully steered receive beams 21, 22, 23, 24 in the correct direction corresponding to the four incoming signals. This simulation used a linear array of antenna elements 12 to demonstrate that the present invention performs effectively. Preferably, however, the system 10 of the present invention would employ the antenna elements 12 in a two dimensional array of some kind.

Figure 3:
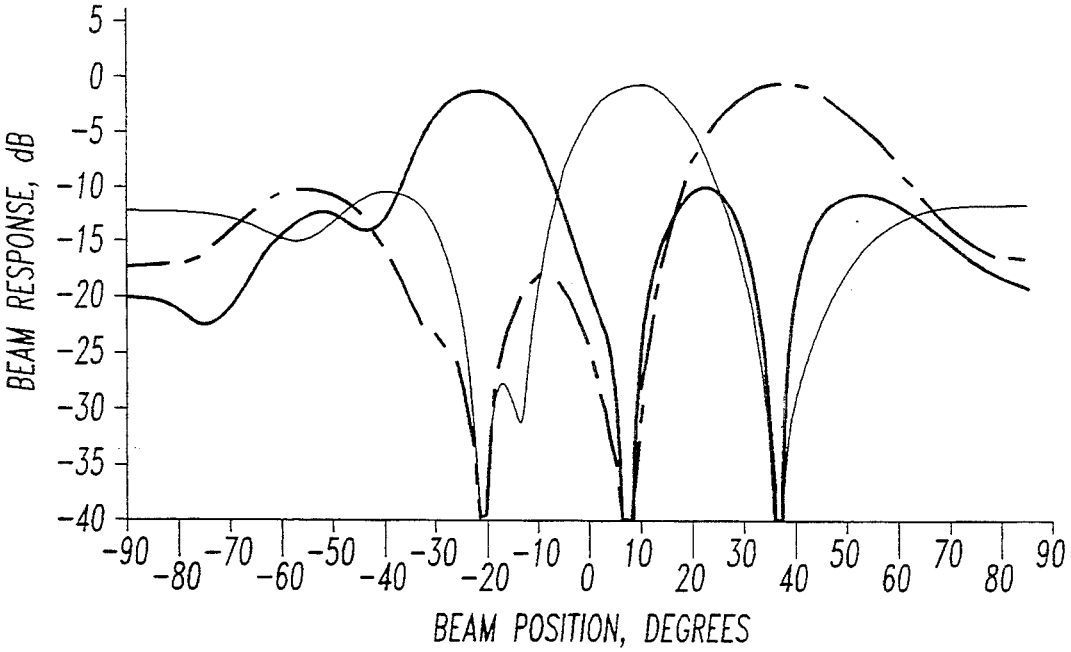
FIG. 3 shows an example of receive beam positioning performed in accordance with the present invention for three incoming signals, uncorrelated in time, simultaneously impinging from three different directions on a six element linear antenna array, in which three separate receive beams were formed, each pointing toward the direction of one of the three incoming signals.

Also in accordance with the present invention, FIG. 3 shows the results of another simulation, in which three uncorrelated incoming signals were simultaneously impinging from three different directions (i.e., −20 degrees, 10 degrees, and 40 degrees) on an array of antenna elements 12. Three separate receive beams 31, 32, 33 were computed from the same data sample, and the system of the present invention successfully created receive beams 31, 32, 33 in the three corresponding directions, demonstrating the capability of the system 10 to form simultaneous receive beams 19 for different incoming signals. As shown in FIG. 3, beam 31 corresponds and is directed toward the −20 degree incoming signal; beam 32 corresponds and is directed toward the 10 degree incoming signal; and beam 33 corresponds and is directed toward the 40 degree incoming signal.

FIG. 3 also shows that the least squared error criterion of equation (7) is achieved at least partly by positioning the peak of each receive beam 31, 32, 33 in the direction of the corresponding desired incoming signal, and at least partly by notching out the other, noncorresponding incoming signals, as shown by the notches indicated by reference numerals 34, 35, and 36. Such a notching effect will generally occur when there are less incoming signals than the number of antenna elements 12 (i.e., degrees of freedom) in the array. If, on the other hand, more incoming signals are impinging on the system 10 than there are array elements, the least squared error will generally be achieved by lowering the sidelobes in which the noncorresponding signals lie. Thus, the system of the present invention can achieve interference rejection in some circumstances.

The system of the present invention can be applied to small, mobile satellite receivers or to large ground based tracking stations. Digital processor throughput required is tied to the update rate required, which is a function of platform (e.g., vehicle) and/or satellite motion. Current estimates place it well within the means of current and projected digital signal processing technology.

It will be apparent to those skilled in the art that various modifications can be made in the system and method of the present invention without departing from the spirit or scope of the invention. Thus, it is intended that the present invention cover the modifications and variations of this invention provided they come within the scope of the appended claims and their equivalents.

What is claimed is:

1. A system for automatically forming at least one receive beam positioned in the direction of a corresponding at least one incoming signal, said system having at least one known signal corresponding to said at least one incoming signal, said system comprising:

a plurality, M, of channels, each of said plurality of channels collecting said at least one incoming signal and generating a plurality, L, of incoming complex data samples for said at least one incoming signal and a plurality, L, of known complex data samples for said at least one known signal; and a plurality of digital beamforming means for forming said at least one receive beam, each of said plurality of digital beamforming means including means, coupled to said plurality of channels, for computing an M by 1 weight vector, W, having a plurality, M, of weight elements each corresponding to one of said plurality of channels, said computing means including means for solving the following equation for W:

$$R\,W=C,$$

wherein R is an M by M coefficient matrix, an element in the i-th row and the j-th column of said coefficient matrix being an estimate of a value obtained from cross-correlating the incoming complex data sample generated by the i-th channel with the incoming complex data sample of the j-th channel, and wherein C is an M by 1 constant vector, an element in the i-th row of said constant vector being an estimate of a value obtained from cross-correlating the incoming complex data sample generated by the i-th channel with the plurality of known complex data samples, a plurality, M, of multipliers for generating a plurality of weighted signals, each of said plurality of multipliers coupled to a corresponding one of said plurality of channels and including means for multiplying one of said plurality of weight elements by said plurality of complex data samples generated by said corresponding channel, and an adder, coupled to said plurality of multipliers, for adding each of said plurality of weighted signals.

2. The system recited in claim 1, wherein $R=X^*X^T$, X being an M by L data matrix, an element in the i-th row and the j-th column of said data matrix being the j-th incoming complex data sample generated by the i-th channel;

wherein $X^*$ is the complex conjugate of X;

wherein $X^T$ is the transpose of X; and wherein $C=X^*D$, D being an L by 1 data vector of the plurality of known complex data samples.

3. The system recited in claim 1, wherein the at least one incoming signal has a transmission frequency band, and wherein each of the plurality of channels converts the at least one incoming signal from said transmission frequency band to a baseband frequency centered at 0 Hz.

4. The system recited in claim 1, wherein the plurality of weight elements are periodically recomputed by the computing means according to a predetermined frequency.

5. The system recited in claim 4, wherein the predetermined frequency is in the range of 2 Hz to 10 Hz.

6. A method for automatically forming at least one receive beam positioned in the direction of a corresponding at least one incoming signal, said system having at least one known signal corresponding to said at least one incoming signal, said method comprising:

collecting, using a plurality of channels, said at least one incoming signal and generating a plurality, L, of incoming complex data samples for said at least one incoming signal and a plurality, L, of known complex data samples for said at least one known signal; and digitally forming said at least one receive beam, including computing an M by 1 weight vector, W, having a plurality, M, of weight elements each corresponding to one of said plurality of channels, including solving for W the equation:

$$R\,W=C,$$

wherein R is an M by M coefficient matrix, an element in the i-th row and the j-th column of said coefficient matrix being an estimate of a value obtained from cross-correlating the incoming complex data sample generated by the i-th channel with the incoming complex data sample of the j-th channel, and wherein C is an M by 1 constant vector, an element in the i-th row of said constant vector being an estimate of a value obtained from cross-correlating the incoming complex data sample generated by the i-th channel with the plurality of known complex data samples, multiplying each of said plurality of weight elements by said plurality of complex data samples generated by said corresponding one of said plurality of channels, and adding said multiplied weight elements.

7. The method recited in claim 6, wherein $R=X^*X^T$, X being an M by L data matrix, an element in the i-th row and the j-th column of said data matrix being the j-th incoming complex data sample generated by the i-th channel;

wherein $X^*$ is the complex conjugate of X;

wherein $X^T$ is the transpose of X; and wherein $C=X^*D$, D being an L by 1 data vector of said plurality of known complex data samples.

8. The method recited in claim 6, wherein the at least one incoming signal includes a transmission frequency band, and wherein the processing step includes converting the at least one incoming signal from said transmission frequency band to a baseband frequency centered at 0 Hz.

9. The method recited in claim 6, wherein the computing step is periodically performed according to a predetermined frequency.

10. The method recited in claim 9, wherein the predetermined frequency is in the range of 2 Hz to 10 Hz.

11. A system for automatically forming a plurality of receive beams, each of said plurality of receive beams being positioned in the direction of one of a corresponding plurality of incoming signals, said system having a plurality of known signals corresponding to one of said plurality of incoming signals, said system comprising:

a plurality, M, of channels, each of said plurality of channels collecting said plurality of incoming signals and generating a plurality, L, of incoming complex data samples for each of said plurality of incoming signals and a plurality, L, of known complex data samples for each of said plurality of known signals; and a plurality of digital beamforming means for forming said plurality of receive beams, each of said plurality of digital beamforming means including means, coupled to said plurality of channels, for computing an M by 1 weight vector, W, having a plurality, M, of weight elements each corresponding to one of said plurality of channels, including means for solving the following equation for W:

$$(X^*X^T)\,W=X^*D,$$

wherein X is an M by L data matrix, an element in the i-th row and the j-th column of said data matrix being the j-th incoming complex data sample generated by the i-th channel, wherein $X^*$ is the complex conjugate of X and $X^T$ is the transpose of X, and wherein D is an L by 1 data vector of said plurality of known complex data samples, a plurality of multipliers for generating a plurality of weighted signals, each of said plurality of multipliers coupled to a corresponding one of said plurality of channels and multiplying one of said plurality of weight elements by said plurality of incoming complex data samples generated by said corresponding one of said plurality of channels, and an adder, coupled to said plurality of multipliers, for adding each of said plurality of weighted signals.

12. A method for automatically forming a plurality of receive beams, each of said plurality of receive beams being positioned in the direction of one of a plurality of incoming signals, said system having a plurality of known signals each corresponding to one of said plurality of incoming signals, said system comprising:

collecting, using a plurality of channels, said plurality of incoming signals and generating a plurality, L, of incoming complex data samples for each of said plurality of incoming signals and a plurality, L, of known complex data samples for each of said plurality of known signals; and digitally forming said plurality of receive beams, including computing, for each of said plurality of incoming signals, an M by 1 weight vector, W, having a plurality of weight elements each corresponding to one of said plurality of channels, including solving the following equation for W:

$$(X^*X^T)\,W=X^*D,$$

wherein X is an M by L data matrix, an element in the i-th row and the j-th column of said data matrix being the j-th incoming complex data sample generated by the i-th channel, wherein $X^*$ is the complex conjugate of X and $X^T$ is the transpose of X, and wherein D is an L by 1 data vector of said plurality of known complex data samples, multiplying, for each of said plurality of incoming signals, each of said plurality of weight elements by said plurality of incoming complex data samples generated by said corresponding one of said plurality of channels, and adding, for each of said plurality of incoming signals, each of said multiplied weight elements.

* * * * *